US009631861B1

(12) United States Patent
Dinter et al.

(10) Patent No.: US 9,631,861 B1
(45) Date of Patent: Apr. 25, 2017

(54) HOME APPLIANCE COMPRISING AN ILLUMINATION ELEMENT

(71) Applicant: BSH HAUSGERAETE GMBH, Munich (DE)

(72) Inventors: Lars Dinter, Munich (DE); Mustafa Ertik, Tekirdag (TR); Tanzer Yildizgoecer, Tekirdag (TR)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 14/757,654

(22) Filed: Dec. 23, 2015

(30) Foreign Application Priority Data

Dec. 23, 2014 (TR) ..... A 2014/15583

(51) Int. Cl.

| | |
|---|---|
| ***F25D 27/00*** | (2006.01) |
| ***F21V 33/00*** | (2006.01) |
| ***F21V 15/01*** | (2006.01) |
| ***F25D 23/06*** | (2006.01) |
| ***F25D 17/06*** | (2006.01) |
| *F21W 131/305* | (2006.01) |

(52) U.S. Cl.
CPC ..... *F25D 27/00* (2013.01); *F21V 15/01* (2013.01); *F21V 33/0044* (2013.01); *F25D 17/062* (2013.01); *F25D 23/065* (2013.01); *F21W 2131/305* (2013.01)

(58) Field of Classification Search
CPC ..... F25D 27/00; F25D 17/062; F25D 23/065; F21V 15/01; F21V 33/004; F21W 2131/305
USPC ..... 362/92, 94, 133, 154, 155
See application file for complete search history.

(56) References Cited

U.S. PATENT DOCUMENTS

| | | | | |
|---|---|---|---|---|
| 7,572,025 | B2 * | 8/2009 | Shibusawa | A47F 3/0469 362/126 |
| 2009/0133425 | A1 | 5/2009 | Goerz et al. | |
| 2013/0027906 | A1 * | 1/2013 | Ueda | F25D 27/00 362/92 |
| 2013/0128494 | A1 * | 5/2013 | Seo | F25D 27/00 362/92 |

* cited by examiner

*Primary Examiner* — Laura Tso
(74) *Attorney, Agent, or Firm* — Laurence A. Greenberg; Werner H. Stemer; Ralph E. Locher

(57) ABSTRACT

A home appliance, particularly a cooling device with a housing, has an illumination element positioned on the upper wall of the housing for illuminating the housing and the upper wall of the housing. The upper wall includes an illumination region which incorporates the illumination element and where the illumination element is positioned at a higher position than a lower region of the upper wall. The lower region is closer to the front side of the home appliance than the illumination element.

14 Claims, 3 Drawing Sheets

HOME APPLIANCE COMPRISING AN ILLUMINATION ELEMENT

TECHNICAL FIELD

The present invention relates to home appliances having an illumination element for providing illumination of the interior side of the home appliance.

KNOWN STATE OF THE ART

Illumination elements are used for illuminating the interior of home appliances' housings. In general, said illumination elements are activated in case the door of the home appliance is opened, in other words, said illumination elements are activated when required. When the illumination elements are activated, the light emitted by said illumination elements provides the interior of the housing to be viewed by the user. However, since the light emitted by the illumination element directly reaches the user, the eyes of the user may be dazzled. This prevents the user from looking into the housing in a comfortable manner, and thereby it eliminates the usage comfort of the home appliance.

The cooling device disclosed in the application with reference US2009133425 is in particular a no-frost device, refrigerator and/or freezer, comprising a thermally insulating housing containing at least one product storage compartment that can be supplied with cold air by a fan and an evaporator housing that holds an evaporator. According to the invention, the evaporator housing is thermally separated from the storage compartment by a partition.

The device moreover comprises an electronic control system for controlling the cooling device, and at least one light source for illuminating the storage compartment. The evaporator, the compartment and the electronic control system are provided in module form and/or the evaporator, compartment and the light source are provided in module form. Said cooling device is characterized in that it is particularly reliable and efficient, it can be produced with low cost, and its maintenance is easy.

BRIEF SUMMARY OF THE INVENTION

The object of the present invention is to provide a home appliance comprising a housing having an improved illumination which does not dazzle the eyes of the user.

The present invention is a home appliance, particularly a cooling device comprising a housing, and an illumination element positioned on the upper wall of the housing for illuminating the housing and the upper wall of the housing. Accordingly, the present invention is characterized in that the upper wall comprises an illumination region which incorporates said illumination element and where the illumination element is positioned at a higher position than a lower region of the upper wall, and the lower region is closer to the front side of the home appliance than the illumination element. Thus, the user is avoided from directly exposing to the illumination element and accordingly to the light, preventing dazzling of the eyes of the user.

In a preferred embodiment of the present invention, the illumination region comprises a rear edge which is a rear edge of the upper wall. Thus, the illumination element can be positioned at the furthermost point to the user so that user is partially or completely prevented from directly exposing to the illumination element.

In a preferred embodiment of the present invention, the illumination region comprises a folded edge which is folded towards the rear side of the upper wall. Thus, the resistance of the illumination element having the illumination element can be increased. Moreover, in the upper wall alternatives which are in plate form, the thin sharp edge can be prevented from harming the user during cleaning and/or maintenance.

In a preferred embodiment of the present invention, the illumination element is positioned on a rear face of the illumination region. Thus, the illumination element can be concealed at the rear side of the upper wall which is substantially out of sight of the user.

In a preferred embodiment of the present invention, the illumination element is aligned with a front face of the illumination region. Thus, the illumination element can be positioned inside the housing without occupying space. Thus, space saving can be provided in the housing volume. Moreover, by means of the illumination element which does not extend from the upper wall, in the light of the known state of the art, the object of the present invention is to reduce the possibility of the user being subject to the light emitted by the illumination element.

In a preferred embodiment of the present invention, the illumination region comprises a housing provided on the front face for positioning the illumination element as aligned with the front face of the illumination region. Such an alignment facilitates assembly and ensures further advantages.

In a preferred embodiment of the present invention, the upper wall is a covering plate separate an upper wall of the housing of the home appliance. Thus, the upper wall, whereto the illumination element is secured, can be fixed to the home appliance in a removable manner. By means of the upper wall which can be separated from the home appliance when required, the processes like maintenance and/or cleaning can be easily realized. In case of part replacement, the illumination element can be replaced without needing change of the whole home appliance. Moreover, in case the home appliance is a cooling device, there may remain no need to leave the door of the cooling device open for the maintenance and/or cleaning process. In addition to these, since the illumination element is assembled to an upper wall which is in external plate form, in thermally isolated cooling devices, the production of the device can be facilitated and/or the cost can be reduced.

In a preferred embodiment of the present invention, the upper wall is a covering plate which at least partially conceals a functional element of the home appliance. Thus, a functional element like evaporator, fan, etc. can be kept out of user's sight or intervention.

In a preferred embodiment of the present invention, the home appliance comprises a gap between a rear wall of the housing and the upper wall of the housing in order to provide operability of the functional element. Thus, the air, provided inside the housing, can be returned particularly on an evaporator provided in a cooling device, and the evaporator can cool the air provided in the housing.

In a preferred embodiment of the present invention, the upper wall comprises a hanger element connected to a fixed region of the home appliance. Thus, the upper wall can be carried, and it can be secured in a fixed and balanced manner.

In a preferred embodiment of the present invention, the lower region of the upper wall is a plate which faces downwardly into the housing. Thus, an upper wall can be provided which conceals the illumination element while allowing user to view all possible sections of the housing. Moreover, a flat bottom region can provide facilitating of the cleaning processes. Additionally, the volume of the housing can be used with maximum efficiency.

In a preferred embodiment of the present invention, the illumination region is a plate which is horizontally spaced apart from the lower region of the upper wall. Thus, the lower region can be prevented from blocking the light emitted by the illumination element. However, in some possible embodiments, the lower region may prevent some part of the light from reaching directly to the housing. Thus, formation of light arcs or light lines on the side walls of the housing can be prevented. By means of this, customer satisfaction can be provided.

In a preferred embodiment of the present invention, the illumination region is a plate which is parallel with respect to the lower region of the upper wall. Thus, the production of the upper wall can be facilitated. Moreover, in the lower region embodiment facing downwardly to the housing, the illumination region can directly face the housing. By means of this, the illumination element can be fixed without needing an additional angular positioning. This may provide simplicity in the assembly and in the labor.

In a preferred embodiment of the present invention, the upper wall comprises a bridge element which extends between the illumination region and the lower region of the upper wall and which connects the illumination region and the lower region of the upper wall. Thus, the upper wall can be provided by means of shaping a single plate. This may reduce the labor and material costs. Additionally, by means of curved embodiments, the resistance of the upper wall can be high.

DESCRIPTION OF THE INVENTION

In this detailed description, the subject matter home appliance (1) is explained with references to examples without forming any restrictive effect only in order to make the subject more understandable.

Figure 1:
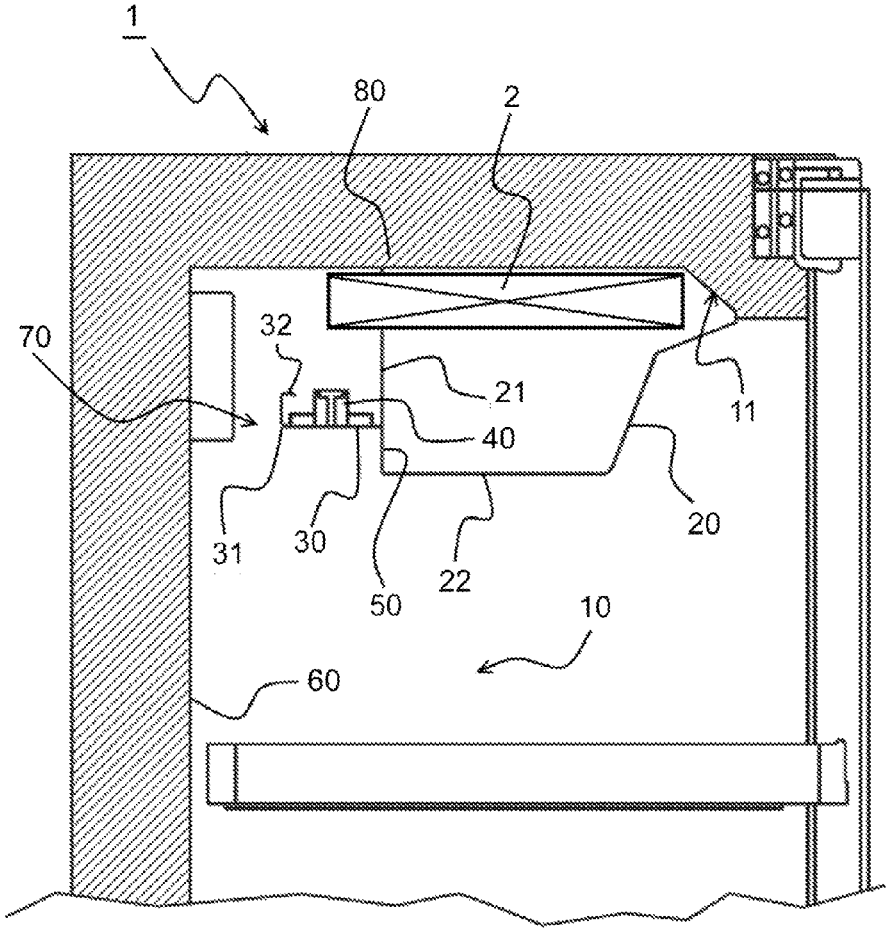
FIG. 1 is a representative cross sectional view of the subject matter home appliance.

With reference to FIG. 1, the subject matter home appliance (1) has a housing (10). Inside said housing (10), there is at least one functional element (2) positioned on the housing upper wall (11). Said functional element can be a heat exchanger, particularly an evaporator or a fan. On the rear side of the functional element (2), there is at least one gap (70) between the housing upper wall (11) and the rear wall (60) of the housing (10). Said gap (70) can be a gap (70) which is required in order for the functional element (2) to fulfill its function. When the functional element is an evaporator, said gap is used for displacing the air, provided in the housing (10), in order to cool said air. Moreover, a fan can be positioned in said gap.

Inside said housing (10), there is an upper wall (20) which at least partially conceals the functional element (2). Thus, the upper wall (20) at least partially prevents the functional element (2) and the housing upper wall (11) to be viewed by the user. Said upper wall (20) is provided in the form of a covering plate in a different manner from the housing upper wall (11). Thus, the upper wall (20) is fixed to the home appliance (1) in a removable manner. When required, the processes like maintenance and cleaning can be easily realized by means of separation from the home appliance (1). In case the home appliance (1) is a refrigerator, while processes like maintenance, etc. are realized, there remains no need to keep open the door which closes the housing (10). The upper wall (20) partially extends towards the rear wall (60) of the home appliance (1), and it is connected to a fixed region (80) of the home appliance (1) by means of at least one hanger element (21). In the present embodiment, said fixed region (80) is the housing upper wall (11). Thus, the upper wall (20) is carried and assembled in a balanced manner. There is no connection between the upper wall (20) and the rear wall (60). In other words, the upper wall (20) is prevented from closing the gap (70). As the hanger element (21), a rod or strip can be used which is made of metal or another material. The hanger element (21) can be connected to the upper wall (20) and/or to the housing upper wall (11) by using welding or pluralities of connection elements. The upper wall (20) has at least one lower region (22) facing into the housing (10).

Figure 2:
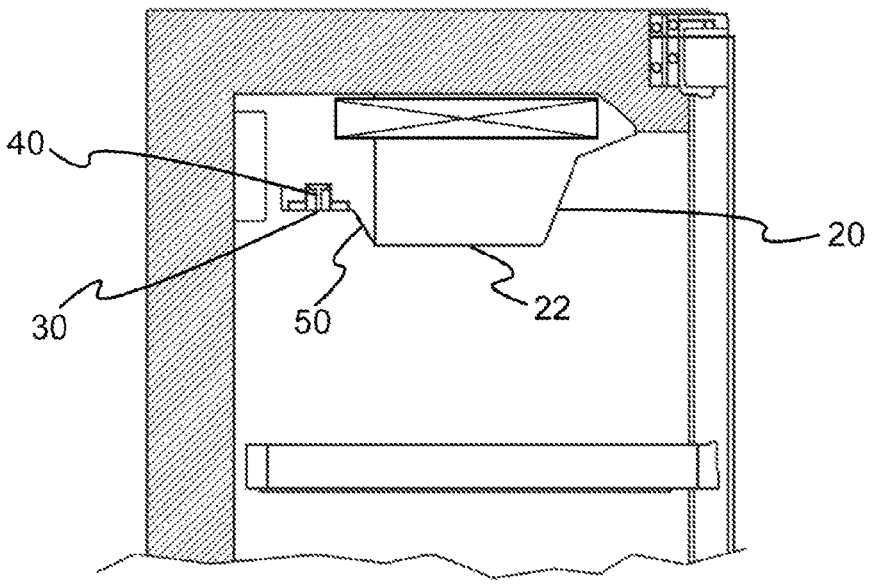
FIGS. 2 and 3 are the representative views of the alternative embodiments of the subject matter home appliance.
Figure 3:
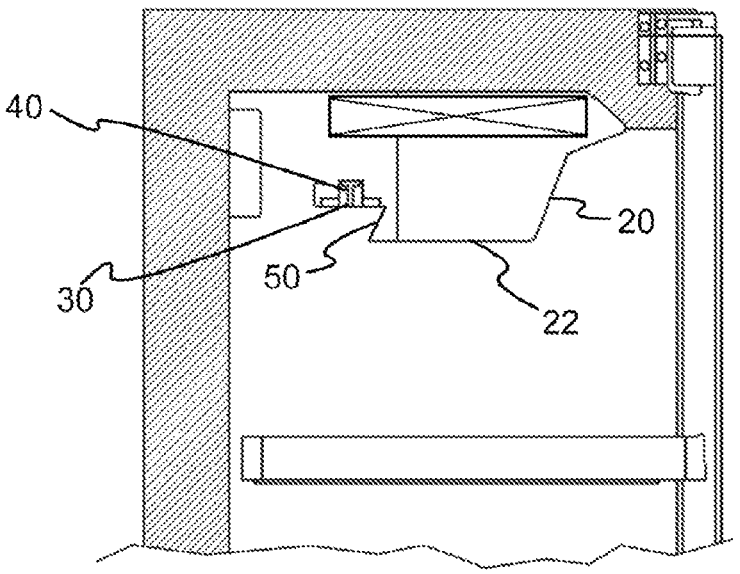

There is at least one illumination region (30) provided between the lower region (22) and the rear wall (60). Said illumination region (30) illuminates a shelf whereon the items are placed, and thus it illuminates said items. Said illumination region (30) is provided in the form of a plate provided in a horizontally spaced apart manner with respect to the lower region (22). The illumination region (30) is connected to the lower region (22), in other words, to the upper wall (20) by means of at least one bridge element (50). Said bridge element (50) can be formed in an integrated manner to the upper wall (20) by means of bending the upper wall (20). In an application of the present invention, as seen in FIG. 1, the bridge element (50) can be orthogonal with respect to the lower region (22), and as seen in FIGS. 2 and 3, it can be provided in a frontally or backwardly inclined manner with respect to the lower region (22). Thus, a vertical distance is formed between the illumination region (30) and the lower region (22). Since the bridge element (50) is formed by means of bending, the resistance of the upper wall (20) is increased. The edge of the illumination region (30) which is opposite with respect to the bridge element (50) is bent upwardly, and thereby a rear edge (31) is defined. Another edge of said rear edge (31) is also bent, and a folded edge (32) is obtained. Said folded edge (32) can be bent towards the rear edge (60) or towards the opposite direction. All of said bending increases the resistance of the upper wall (20).

Figure 4:
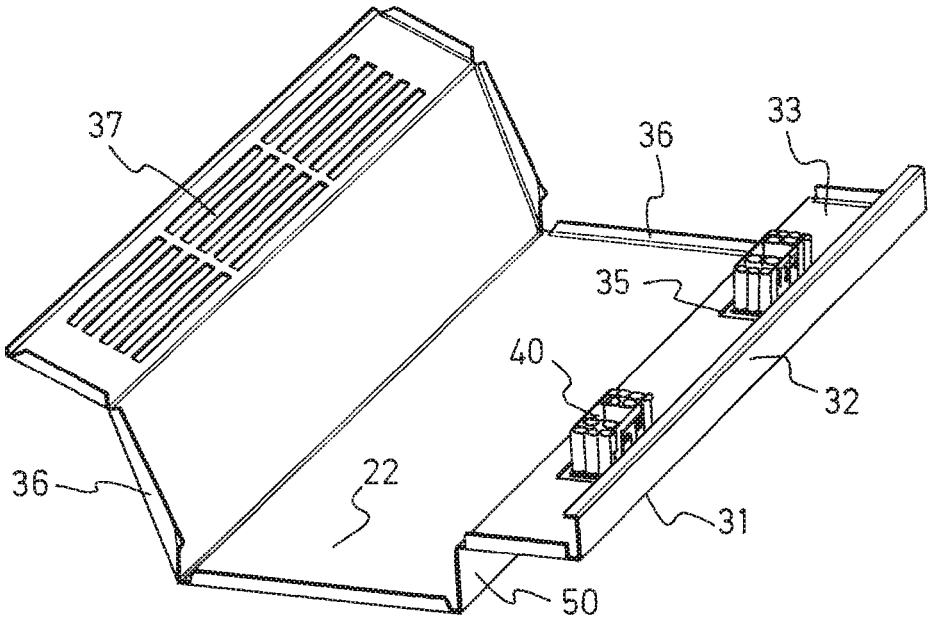
FIG. 4 is the top isometric representative view of the upper wall of the subject matter home appliance.
Figure 5:
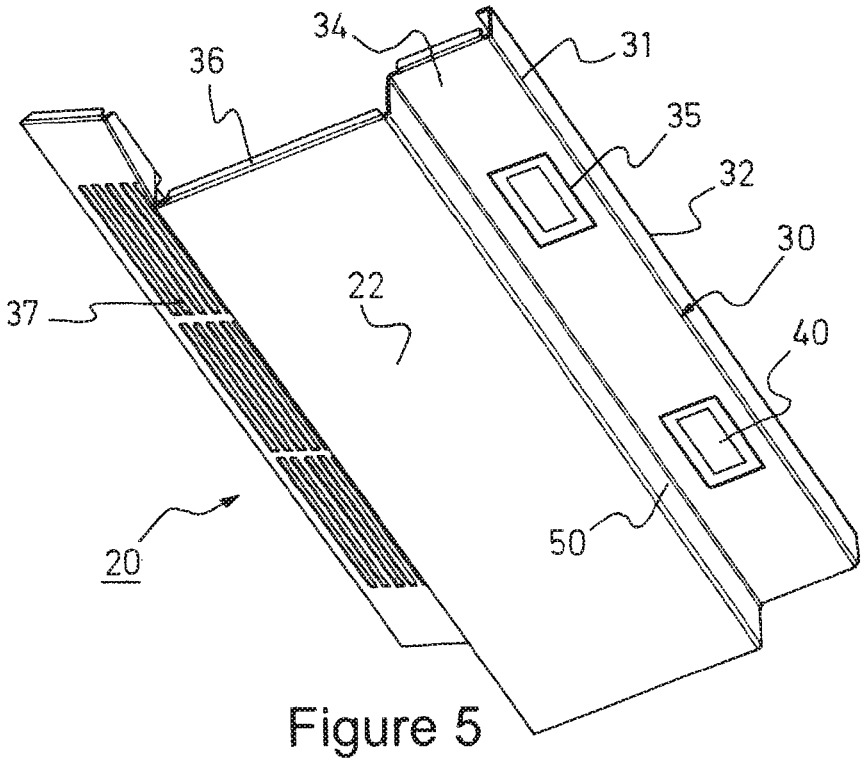
FIG. 5 is the bottom isometric representative view of the upper wall of the subject matter home appliance.

As seen in FIGS. 4 and 5, there is at least one illumination element (40) positioned on the illumination region (30). Said illumination element (40) can be a LED, a light bulb or a similar light source. As seen in FIG. 4, the illumination element (40) is preferably provided on a rear face (33) of the illumination region (30). Thus, the illumination element (40) is positioned such that the user cannot view. The body of the illumination element is provided above the illumination region. As seen in FIG. 5, the illumination element (40) is positioned in at least one housing (35) provided on a front face (34) of the illumination region (30).

Moreover, as seen in FIGS. 4 and 5, there are side folding (36) provided on the sides of the upper wall (20). By means of said side folding (36), the connection of the upper wall (20) to the housing (10) walls is provided. Said connection can be made by means of methods like welding, screwing, etc. Moreover, air passage channels (37) are provided on the upper wall (20). Air suction can be provided to the evaporator through the air passage channels (37).

In the light of said details, the housing (10) has a door provided opposite to the rear wall (60). Said door is used for access into the housing (10). In case said home appliance (1) is a cooling device, particularly a domestic refrigerator, the upper wall (20) coincides to the eye level of an adult or it coincides to a level slightly lower than the eye level. In the subject matter embodiment, since the illumination region (30) is at a higher position than the lower region (22), the bridge element (50) and the lower region (22) prevent the light, emitted by the illumination element (40), from reaching directly to the eye of the user. Thus, while the illumination element (40) provides illumination of the interior side of the housing (10), the dazzling of the eye of the user is prevented.

In other words, according to all of said embodiments, since the illumination element (40) is provided between the upper wall (20) and the rear wall (60) and above the lower region (22), the direct reaching of the light, emitted by the illumination element (40), to the user is prevented, and the dazzling of the eyes of the user is prevented.

REFERENCE NUMBERS

1 Home appliance
2 Functional element
10 Housing
11 Housing upper wall
20 Upper wall
21 Hanger element
22 Bottom region
30 Illumination region
31 Rear edge
32 Folded edge
33 Rear face
34 Front face
35 Housing
36 Side folding
37 Air passage channel
40 Illumination element
50 Bridge element
60 Rear wall
70 Gap
80 Fixed region

The invention claimed is:

1. A home appliance, comprising:

a housing having an upper wall formed with an illumination region, and said illumination region having a rear edge which is a rear edge of said upper wall;

an illumination element incorporated in said illumination region of said upper wall of said housing and disposed for illuminating said housing and said upper wall;

said illumination element being positioned at a higher position than a lower region of said upper wall, and wherein said lower region of said upper wall is closer to a front side of the home appliance than said illumination element.

2. The home appliance according to claim 1, configured as a cooling device.

3. The home appliance according to claim 1, wherein said illumination region comprises a folded edge which is folded towards a rear side of said upper wall.

4. The home appliance according to claim 1, wherein said illumination element is positioned on a rear face of said illumination region.

5. The home appliance according to claim 1, wherein said illumination element is aligned with a front face of said illumination region.

6. The home appliance according to claim 5, wherein said illumination region comprises a housing provided on a front face thereof for positioning said illumination element as aligned with the front face of said illumination region.

7. The home appliance according to claim 1, wherein said lower region of said upper wall is a plate that faces downwardly into said housing.

8. The home appliance according to claim 1, wherein said illumination region is a plate extending parallel to said lower region of said upper wall.

9. The home appliance according to claim 1, wherein said upper wall comprises a bridge element that extends between said illumination region and said lower region of said upper wall and that connects said illumination region and said lower region of said upper wall.

10. A home appliance, comprising:

a housing having an upper wall formed with an illumination region, said upper wall being a covering plate separate from an upper housing wall of the home appliance;

an illumination element incorporated in said illumination region of said upper wall of said housing and disposed for illuminating said housing and said upper wall;

said illumination element being positioned at a higher position than a lower region of said upper wall, and wherein said lower region of said upper wall is closer to a front side of the home appliance than said illumination element.

11. The home appliance according to claim 10, wherein said upper wall is a covering plate which at least partially conceals a functional element of the home appliance.

12. The home appliance according to claim 11, wherein a gap is formed between a rear wall of said housing and said upper wall of said housing in order to provide operability of the functional element.

13. The home appliance according to claim 10, wherein said upper wall is a hanger element connected to a fixed region of the home appliance.

14. A home appliance, comprising:

a housing having an upper wall formed with an illumination region, said illumination region being a plate that is horizontally spaced apart from a lower region of an upper housing wall of the home appliance;

an illumination element incorporated in said illumination region of said upper wall of said housing and disposed for illuminating said housing and said upper wall;

said illumination element being positioned at a higher position than a lower region of said upper housing wall, and wherein said lower region of said upper housing wall is closer to a front side of the home appliance than said illumination element.

* * * * *